US005219294A

United States Patent [19]

Marsh et al.

[11] Patent Number: 5,219,294

[45] Date of Patent: Jun. 15, 1993

[54] ELECTRICAL DOCKING CONNECTOR

[75] Inventors: Edward K. Marsh, Kernersville; Richard A. Nelson, Winston-Salem, both of N.C.

[73] Assignee: AMP Incorporated, Harrisburg, Pa.

[21] Appl. No.: 836,142

[22] Filed: Feb. 13, 1992

Related U.S. Application Data

[63] Continuation of Ser. No. 658,483, Feb. 20, 1991, abandoned.

[51] Int. Cl.[5] ..... H01R 9/09

[52] U.S. Cl. ..... 439/79; 439/607; 439/76

[58] Field of Search ..... 439/76, 78–82, 439/95, 547, 603, 607, 692, 748

[56] References Cited

U.S. PATENT DOCUMENTS

| | | | |
|---|---|---|---|
| 3,148,929 | 9/1964 | Gordon | 339/176 |
| 3,395,377 | 7/1968 | Straus | 339/17 |
| 3,692,966 | 9/1972 | Lancaster | 200/51.1 |
| 3,760,335 | 9/1973 | Roberts | 339/99 R |
| 3,963,300 | 6/1976 | Patton et al. | 339/156 R |
| 4,179,178 | 12/1979 | Bachman et al. | 339/111 |
| 4,392,705 | 7/1983 | Andrews, Jr. et al. | 439/79 |
| 4,418,972 | 12/1983 | Benasutti | 339/14 R |
| 4,456,800 | 1/1984 | Holland | 200/5 A |
| 4,458,291 | 7/1984 | Yanagisawa et al. | 361/212 |
| 4,477,134 | 10/1984 | Wright | 339/17 F |
| 4,531,176 | 7/1985 | Beecher, II | 361/424 |
| 4,532,419 | 7/1985 | Takeda | 235/492 |
| 4,568,133 | 2/1986 | Amano et al. | 339/14 R |
| 4,597,631 | 7/1986 | Flores | 439/79 |
| 4,673,236 | 6/1987 | Musolff et al. | 439/609 |
| 4,688,868 | 8/1987 | Noyes | 439/108 |
| 4,692,121 | 9/1987 | Arbogast, Jr. | 439/874 |
| 4,697,864 | 10/1987 | Hayes et al. | 439/444 |
| 4,699,438 | 10/1987 | Kikuta | 439/95 |
| 4,705,339 | 11/1987 | Hayes et al. | 439/277 |
| 4,711,506 | 12/1987 | Tanaka | 439/108 |
| 4,731,031 | 3/1988 | Lemke | 439/76 |
| 4,737,116 | 4/1988 | Slye et al. | 439/92 |
| 4,743,080 | 5/1988 | Siraty | 439/492 |
| 4,767,350 | 8/1988 | Cooper et al. | 439/271 |
| 4,773,878 | 9/1988 | Hansell, III | 439/497 |
| 4,806,109 | 2/1989 | Manabe et al. | 439/108 |
| 4,824,377 | 4/1989 | De Burro | 439/607 |
| 4,824,383 | 4/1989 | Lemke | 439/108 |
| 4,889,497 | 12/1989 | Riches | 439/76 |
| 4,889,502 | 12/1989 | Althouse et al. | 439/607 |
| 4,906,208 | 3/1990 | Nakamura et al. | 439/76 |
| 5,030,140 | 7/1991 | Sugiyama | 439/607 |
| 5,064,391 | 11/1991 | Buchter | 439/733 |
| 5,066,240 | 11/1991 | Verdun | 439/181 |
| 5,085,601 | 2/1992 | Buchter et al. | 439/660 |

*Primary Examiner*—Paula A. Bradley

*Attorney, Agent, or Firm*—Eric Groen; Bruce Wolstoncroft

[57] ABSTRACT

Mating plug and receptacle connectors each include electrically insulating housings and plural rows of electrical terminals. The plug connector includes two terminal supporting walls or platforms extending outwardly from the housing with terminal contact portions positioned in channels on the terminal support platforms. Each platform includes at an end thereof a groove which receives a grounding strip in the form of a drain wire, commoned to an outer shielding shell. The receptacle connector has an insulating housing having two elongate slots thereacross, adapted for receiving the terminal support walls of the plug connector, and receptacle contacts for mating engagement with the plug connector terminals. The receptacle housing includes a groove in the front face carrying a grounding strip commoned to an outer shielding shell. The plug and receptacle are mateable with their respective shielding shells in mating contact with each other.

19 Claims, 19 Drawing Sheets

10
60b
62b
24
60
62

90
24
92
18
30d
34
30
32
60a
62a
38
28
26
62d
60d
6
6
60
62
20
30c
14
12
20
4
90
22
16
10
92

70
72

128
126
120
124
122
128
126
129
129

133
130
132
133
134

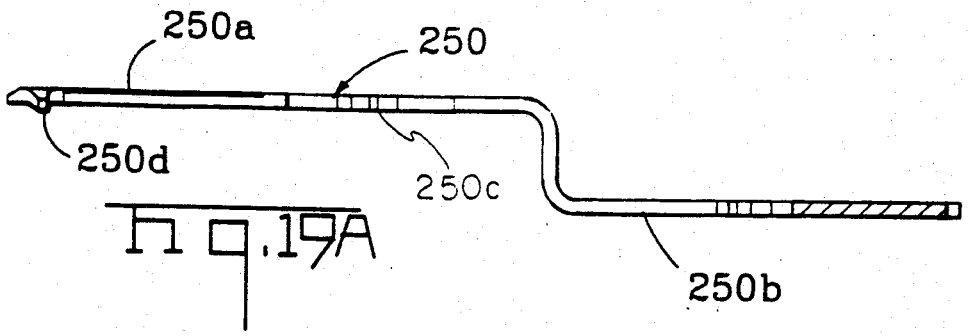
Fig.19A
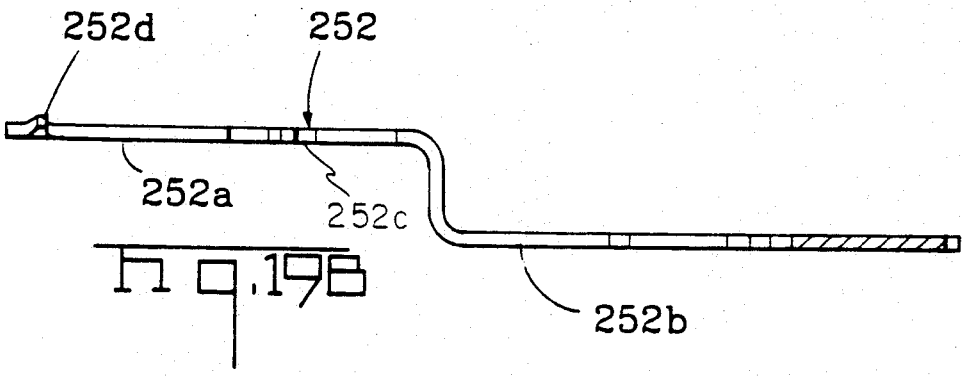
Fig.19B
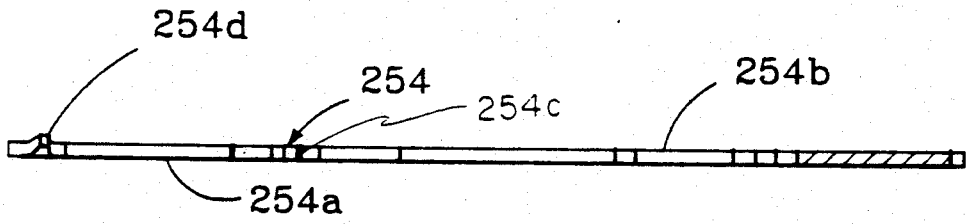
Fig.19C
Fig.20
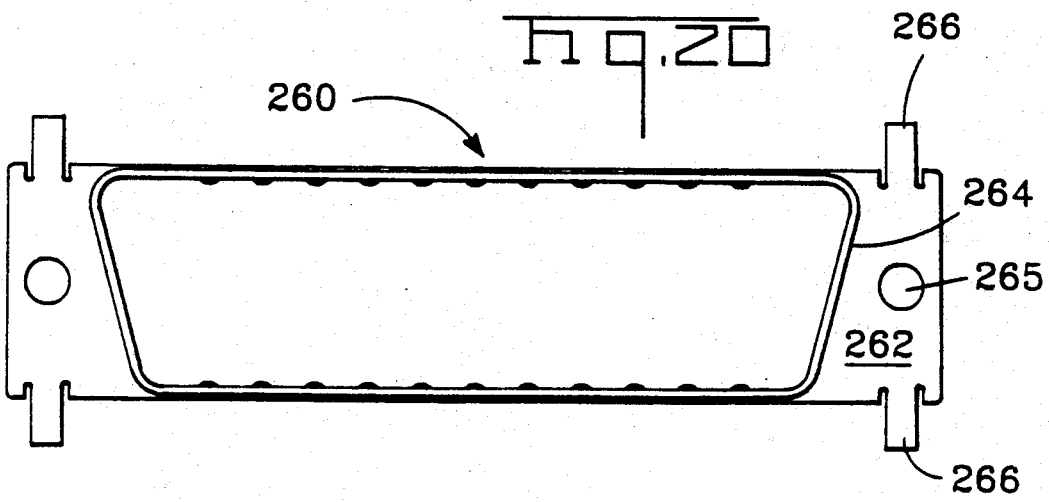

Fig. 30
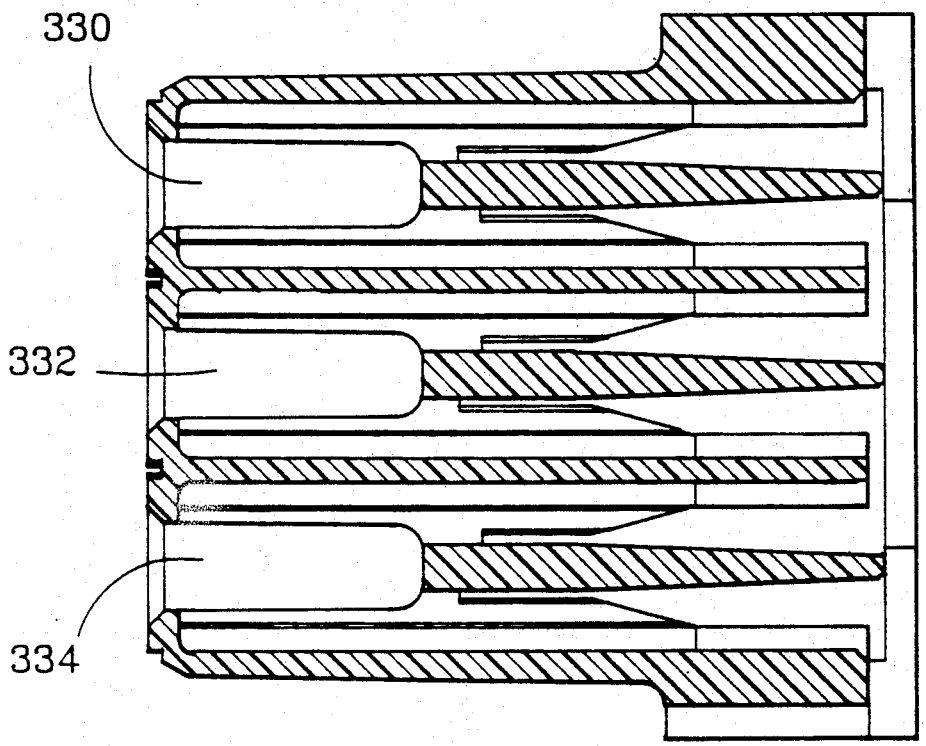
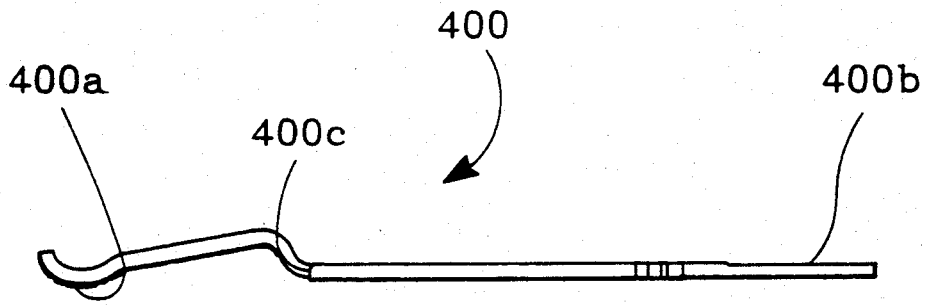
Fig. 31

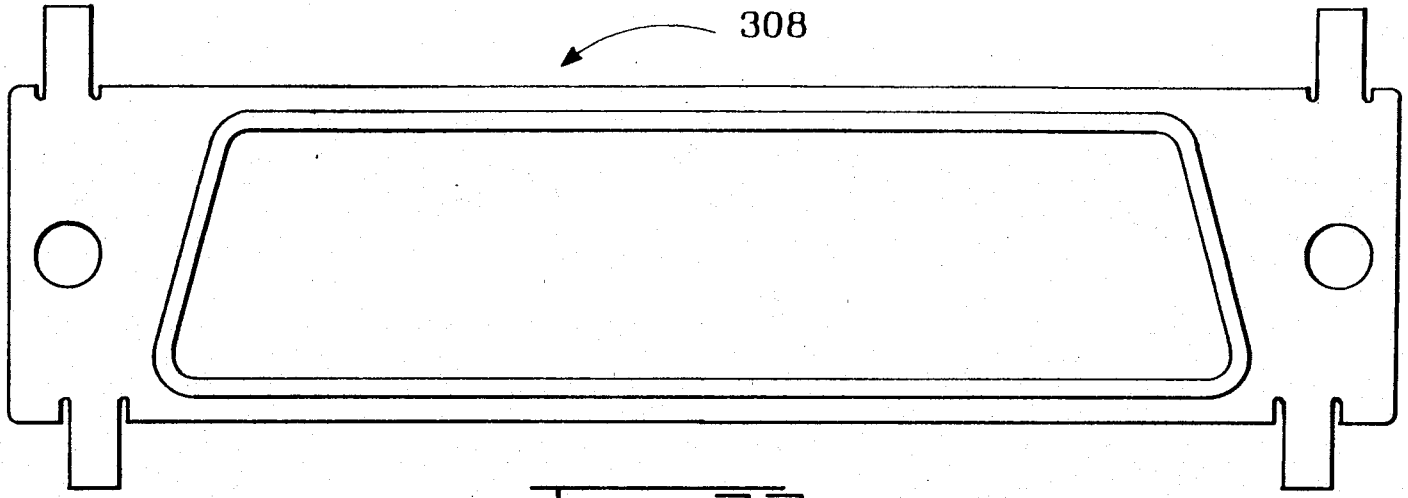
Fig. 72
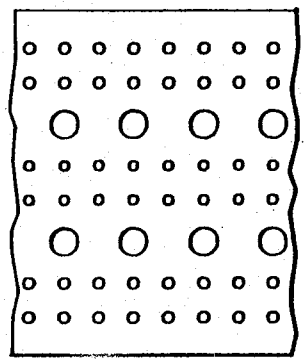
Fig. 77
Fig. 29
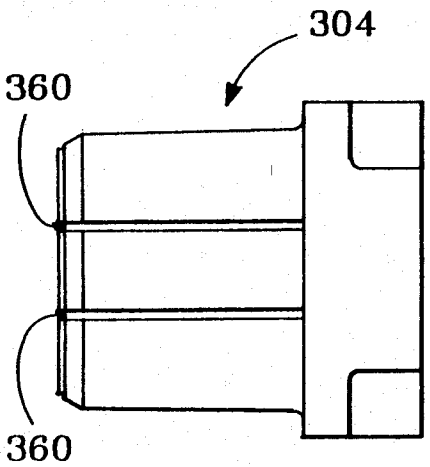

ELECTRICAL DOCKING CONNECTOR

This application is a continuation of application Ser. No. 07/658,483 filed Feb. 20, 1991, now abandoned.

BACKGROUND OF THE INVENTION

1. Field of the Invention

The subject invention relates to a docking connector for interconnecting the data signals of a lap top computer to a desk top computer.

2. Description of the Prior Art

Portable or lap top computers have become quite popular in recent years, for travellers requiring access to a computer while out of the office. One of the disadvantages of the lap top computers is that, due to their compact nature, the computers cannot contain the electronics of a desk top computer, and therefore cannot perform the same capabilities as a desk top computer.

It is typical then that a user of a lap top computer, when returning to the office, downloads the data accumulated during a trip, from the lap top computer to his or her desk top computer. To this end, most lap top computers have several individual connectors, and the lap top computer is interconnected to the desk top computers via data cables between them. Once the data is downloaded into the desk top computer, the data can be stored within a data base, utilized within a network, for example, as electronic mail, or can be sent to peripheral equipment, such as to a printer.

Presently, due to the number of I/O connections, the interconnected pins number between 200–300, and several connectors are required, such as RS-232 and circular DIN type. It is therefore desirable to incorporate all connections into one integral high density electrical connector assembly.

An object of the invention then is to provide a high density electrical connection system having plural rows of electrical connections.

Other objects and advantages of the invention will be apparent from the following description, the accompanying drawings and the appended claims.

SUMMARY OF THE INVENTION

The objects of the invention were accomplished by designing an electrical receptacle connector, comprising an insulating housing having a mating face and a conductor connecting face, at least two elongate slotted openings extending through the front mating face and terminating at a rear wall, the rear wall having two rows of passageways extending therethrough communicating with each slot, one of the rows being adjacent to the upper surface in each slotted opening, and one of the rows being adjacent to the lower surface in each slotted opening. The device also includes a plurality of electrical terminals positioned in the housing, the terminals comprising contact portions, and a discrete lead section extending from each contact portion rearwardly of the front mating face, thereby defining printed circuit board contacts, the terminals positioned in the passageways with contact portions positioned adjacent to the upper surface in each slotted opening, and a contact portion positioned adjacent to the lower surface in each slotted opening, with contact surfaces facing opposite contact surfaces in the same slotted opening.

By providing the elongate slotted openings, with terminals positioned on opposite surfaces of the openings, the connector density has been substantially increased.

In another aspect of the invention, a plug connector in accordance with the invention comprises an insulating housing having a front mating face, a conductor connecting face, and an intermediate wall between the front mating face and the rear conductor connecting face, the housing comprising at least two terminal support platforms extending outwardly from the intermediate wall, where each platform includes terminal receiving channels formed integrally therein. A plurality of electrical terminals, each comprising a front mating contact portion is disposed in the terminal receiving channels, and conductor connecting portions are positioned adjacent to the conductor connecting face.

BRIEF DESCRIPTION OF THE DRAWINGS

FIG. 3 is a top plan view of the electrical connector housing;

FIG. 9 is a top plan view of the terminal lead frame shown in FIG. 7;

FIG. 13 is a cross-sectional view of the assembled connector;

FIGS. 19A–19C are side plan views of the terminals used in the vertical plug connector shown in FIG. 14;

FIG. 20 is a front plan view of the shield member used with the vertical plug member of FIG. 14;

FIG. 23 shows a cross-sectional view of the plug member;

FIG. 29 is a side plan view of the housing of FIG. 23;

FIG. 30 is a cross-sectional view through lines 30—30 of FIG. 27;

FIG. 31 is a side view of the terminal for use with the vertical receptacle housing of FIG. 23;

FIG. 32 is a front plan view of the shield for use with the vertical receptacle connector assembly; and FIG. 33 is an upper plan view of the tine plate for use with the vertical receptacle assembly.

DETAILED DESCRIPTION OF THE PREFERRED EMBODIMENT

Figure 1:
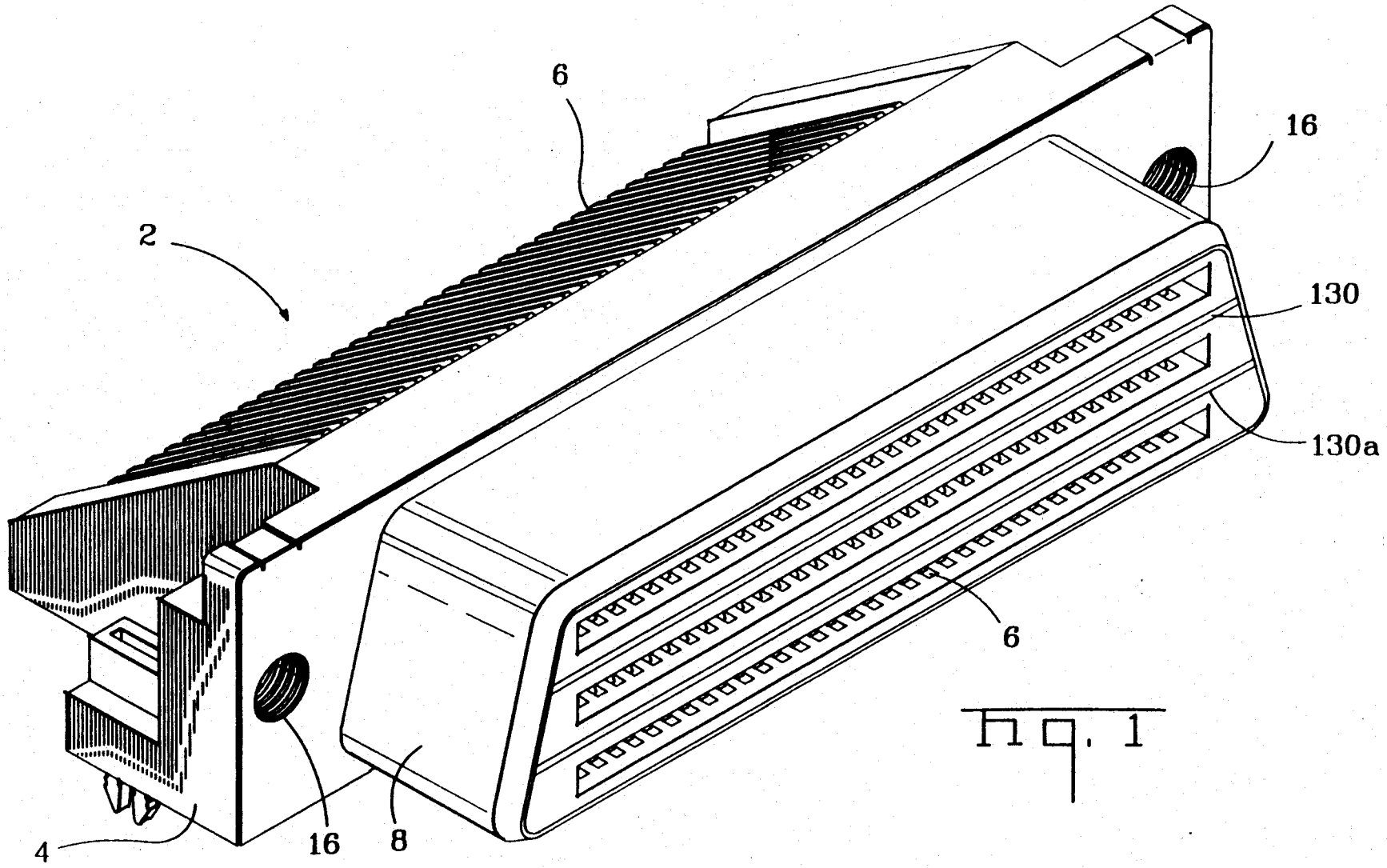
FIG. 1 is an isometric view of the shielded connector of the subject invention.

With reference first to FIG. 1, a shielded electrical receptacle connector is shown, generally at 2, comprising an insulating housing 4 having located therein a plurality of electrical terminals 6 and a front shield member, such as 8.

With reference now to FIGS. 2 through 6, the housing will be described in greater detail. The housing 4 generally includes an intermediate base section 10 having a front face 12 and a mounting surface 14. The base section 10 includes at each side thereof threaded mounting holes such as 16 for securing thereto a mating complementary connector, as will be described in greater detail herein.

Figures 2, 4, 7:
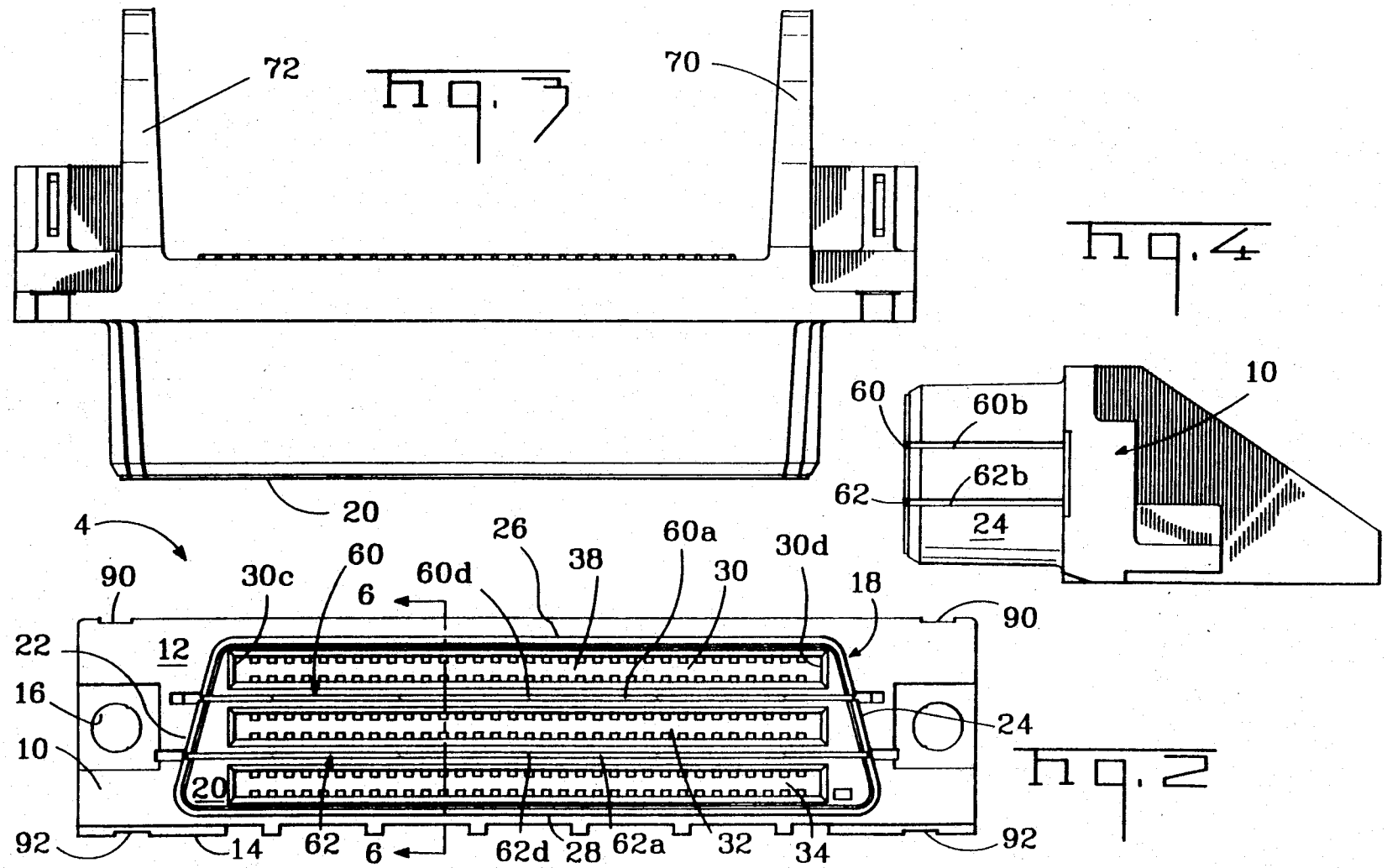
FIG. 2 is a front plan view of the electrical connector housing.
FIG. 4 is a side plan view of the electrical connector housing.
FIG. 7 is a side plan view of the terminal lead frame used in the receptacle connector of the subject invention.

The housing 4 further comprises a front nose portion 18 having a front face 20, side walls 22 and 24, and upper and lower walls 26 and 28, respectively. As shown in FIG. 2, the receptacle includes 3 elongate ports or slots, an upper port 30, an intermediate port 32, and a lower port 34.

Figure 6:
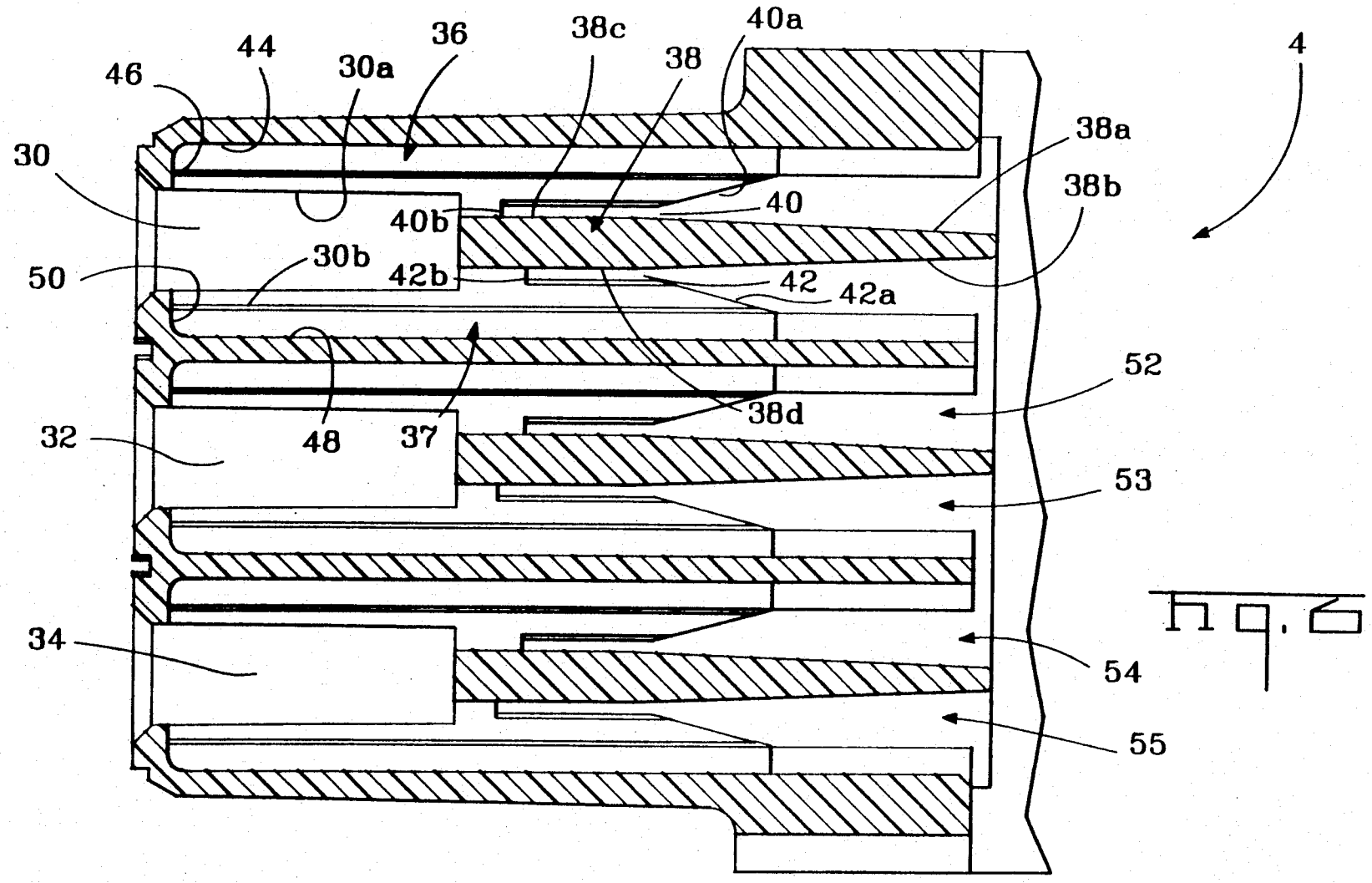
FIG. 6 is a cross-sectional view through lines 6—6 of FIG. 2.

With reference now to FIG. 6, the housing 4 is shown in side section with the slots 30, 32, 34 shown in greater detail. The slot 30 includes an upper surface 30*a* and a lower parallel surface 30*b* and side surfaces 30*c* and 30*d* (FIG. 2). The slot 30 is in communication with a plurality of upper and lower terminal receiving passageways 36 and 37 defined between an intermediate wall portion 38, as shown in FIGS. 2 and 6. The wall portion 38 includes tapered lead in surfaces 38*a* and 38*b* which continue forward and are continuous with generally horizontal surfaces 38*c* and 38*d*, respectively. The terminal receiving passageway 36 further comprises a slot 40 having a lead in surface 40*a* and a forward shoulder 40*b*. The terminal receiving passageway 37 includes a complementary slot 42 having a similar lead in surface 42*a* and a stop shoulder 42*b*. The slot 36 further comprises an upper ceiling portion 44 and a rearward facing shoulder 46. The lower terminal receiving passageway 37 comprises a lower floor portion 48 and a rearwardly facing shoulder 50. As shown in FIG. 6, the slots 32 and 34 are similarly configured as the slot 30 and therefore will not be described in detail. Suffice it to say that the housing 4 includes terminal receiving passageways 52 and 53 in communication with the slot 32 and terminal receiving passageways 54 and 55 in communication with the slot 34.

With reference again to FIG. 2, an elongate groove 60 is disposed between the slots 30 and 32, whereas an elongate groove 62 is positioned between the slots 32 and 34. Each of the grooves includes opposed indentations, as shown at 68*a* and 62*a*, which will be described in greater detail herein.

Figure 5:
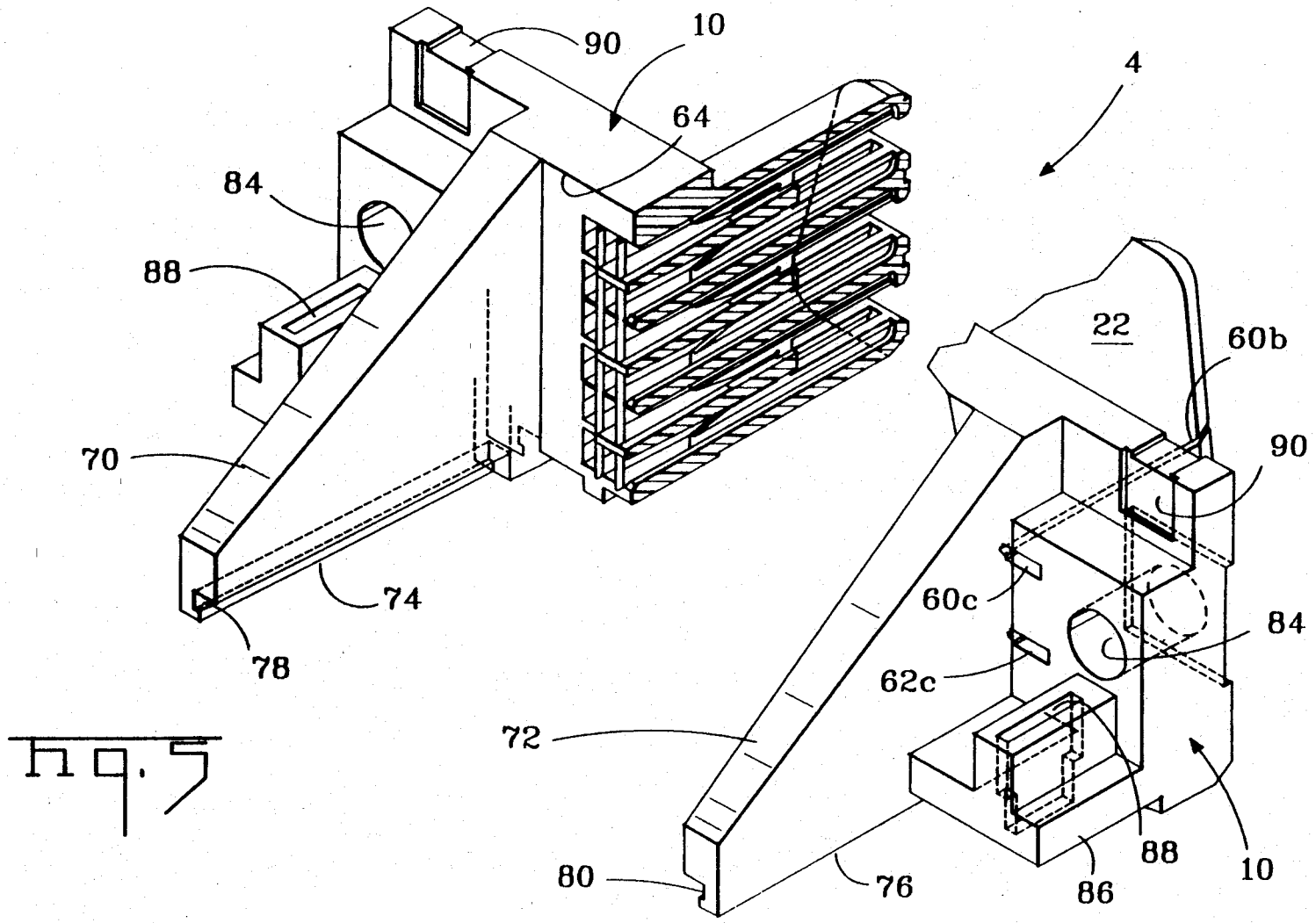
FIG. 5 is a rear isometric view of the connector partially broken away to show the internal structure of the insulative housing.

With reference now to FIG. 4, the grooves 60 and 62 are continuous along the side wall 24 of the shroud having groove sections 60*b* and 62*b*. The groove portions 60*b* and 62*b* also extend through the central wall portion 10 and, as shown in FIG. 5, terminate in slots 60*c* and 62*c*. It should be noted that in FIG. 4 the shroud side wall 24 is in view whereas in FIG. 5, the shroud side wall 22 is in view, although each side wall includes continuous groove sections 60*b* and 62*b* continuous with the side walls 22 and 24 of the shroud 18.

With reference still to FIG. 5, the housing 4 further comprises two mounting legs, such as 70 and 72, where the legs extend away from a rear surface 64 of the central wall portion 10, and include mounting surfaces, such as 74 and 76. Each of the mounting legs 70 and 72 includes horizontal slots, such as 78 and 80, the purpose for which will be described in greater detail herein. In the preferred embodiment of the invention, the central wall portion 10 includes mounting through holes, such as 84, where the through holes 84 include press-fit or molded-in threaded inserts to assist in the mating engagement with a complementary connector. The housing 4 further includes two mounting feet, such as 86, on either side of the mounting legs 70 and 72, having a slot, such as 88, wherein in the preferred embodiment of the invention, the slots 88 include printed circuit board retention features, such as the split arrow device which is well-known in the art. Finally, the central wall portion 10 of the connector housing 4 includes two recesses, such as 90, along the top section thereof, as shown in FIG. 5, and includes two recesses 92, along the lower side thereof, as shown in FIG. 2, as will be described in greater detail herein.

Figure 8:
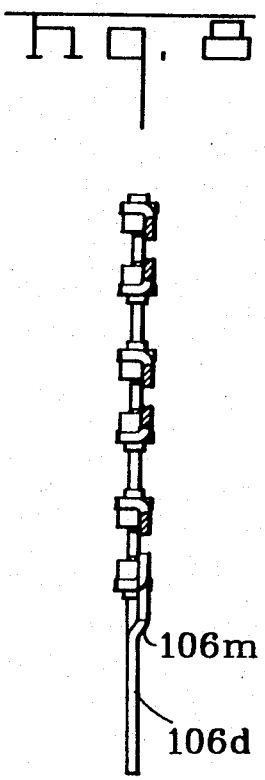
FIG. 8 is an end view of the lead frame of FIG. 7.
Figure 7:
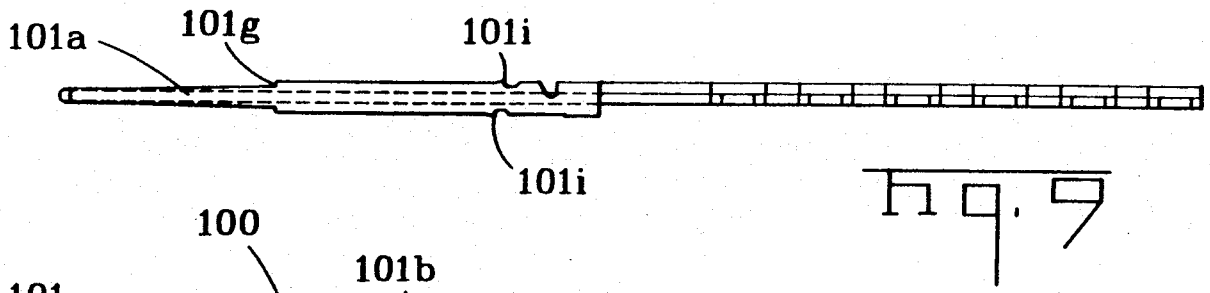
Figure 7:
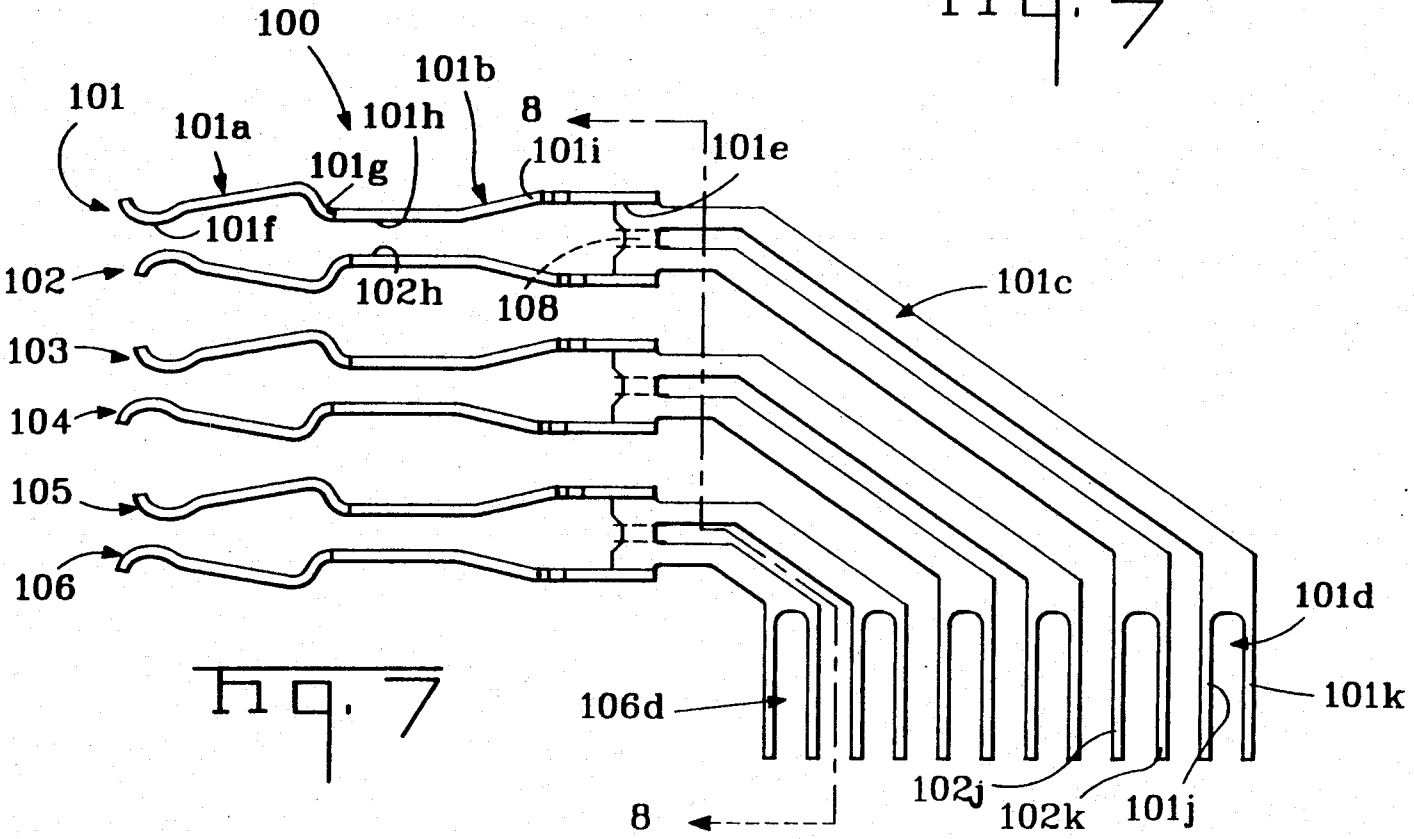

As shown in FIG. 7, the terminals are stamped and formed in the form of a lead frame 100 comprising individual terminals 101 through 106. Each of the terminals comprises similar individual components, so only the first terminal 101 will be described in great detail. With respect to FIG. 7, the terminal 101 generally comprises a contact section 101*a*, a cantilevered beam section 101*b*, an intermediate lead section 101*c* and a printed circuit board contact section 101*d*. It should be noted from the configuration of the lead frame 100 that the individual terminals are stamped in the plane of the intermediate contact section 101*c* and the cantilever beam section 101*b* is then folded about an upper edge 101*e* of the intermediate section 101*c*, with the folded over portion formed into the configuration shown in FIG. 7. In this configuration, the terminal 101 includes a forward contact surface 101*f*, a shoulder 101*g*, a horizontal surface 101*h*, and locking barbs 101*i*. It should be noted that each of the printed circuit board contact sections, such as 101*d*, includes alternative tines 101*j* and 101*k*, where one of the tines can be selected to stagger the pattern of the tines to increase the density of interconnection on a printed circuit board. It should also be noted that two terminals are integrally connected through a web section 108 between the two terminals to maintain the requisite spacing during assembly purposes, as will be described in greater detail herein. It should be noted from FIG. 8 that the printed circuit board contact sections, such as 106*d*, are staggered over at 106m to place the centerline of the printed circuit board contact sections 106d collinear with the centerline of the terminals 101–106.

Figures 10, 11:
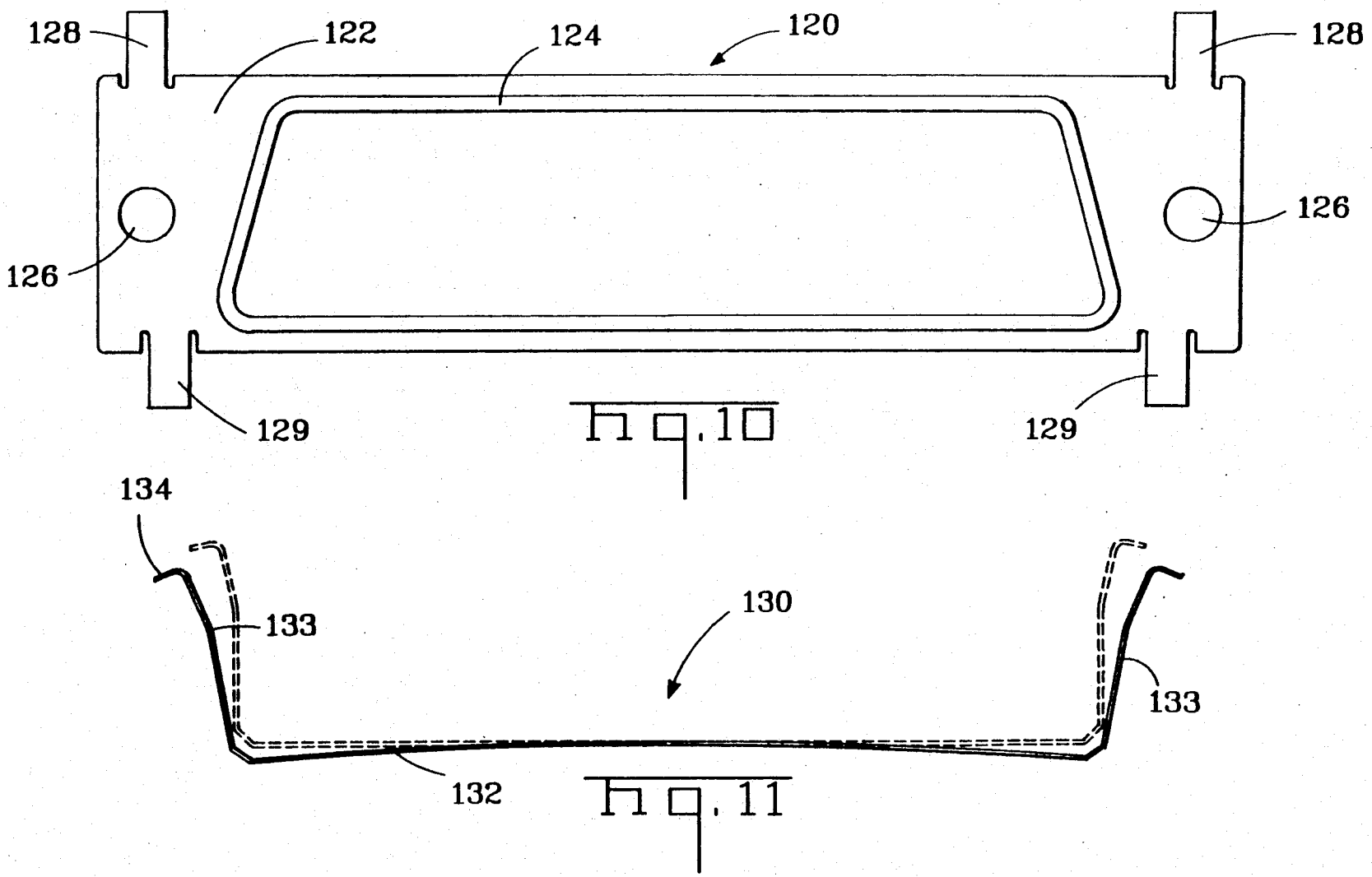
FIG. 10 is a front plan view of the shield member of the subject invention.
FIG. 11 is an upper view of the drain wire of the subject invention.

With reference now to FIG. 10, the front shield member is shown generally at 120 comprising a generally flat plate section 122 having an integral drawn shielding shroud 124 extending forwardly from the plate section 122. The plate section 122 includes through holes 126 profiled to align with the apertures 84 in the housing 4 (FIG. 5) and further comprises integral tab sections 128 profiled to meet the recesses 90 in the housing 4, and tabs 129 which are profiled to meet the recesses 92 in the housing 4.

With reference now to FIG. 11, a drain wire is shown generally at 130 and comprises a front wire section 132, side sections 133, and hook sections 134. It should be noted that the drain wire 130 is formed with the front wire portion 132 in a bent configuration so as to preload the drain wire. Although described in greater detail herein, the drain wire is generally profiled to match the groove 60 in the housing shroud 18 (FIG. 2), with the opposed indentations 60a pinching the wire in place. It should also be noted that a further drain wire 130a (FIG. 1) is also included which is identical to the drain wire 130, although profiled to fit in the groove 62 which is somewhat longer than the groove 60 due to the D-shaped configuration of the front face.

Figure 12B:
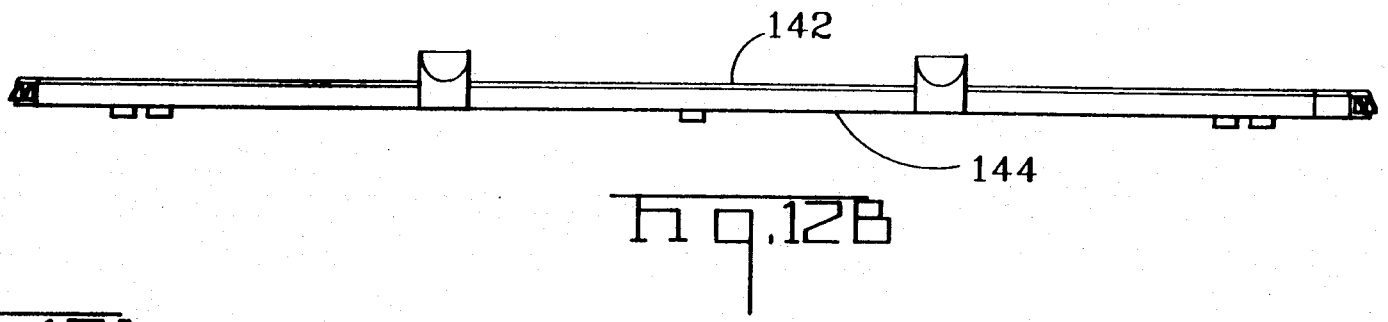
FIG. 12B is a front plan view of the tine plate of the subject invention.
Figure 12A:
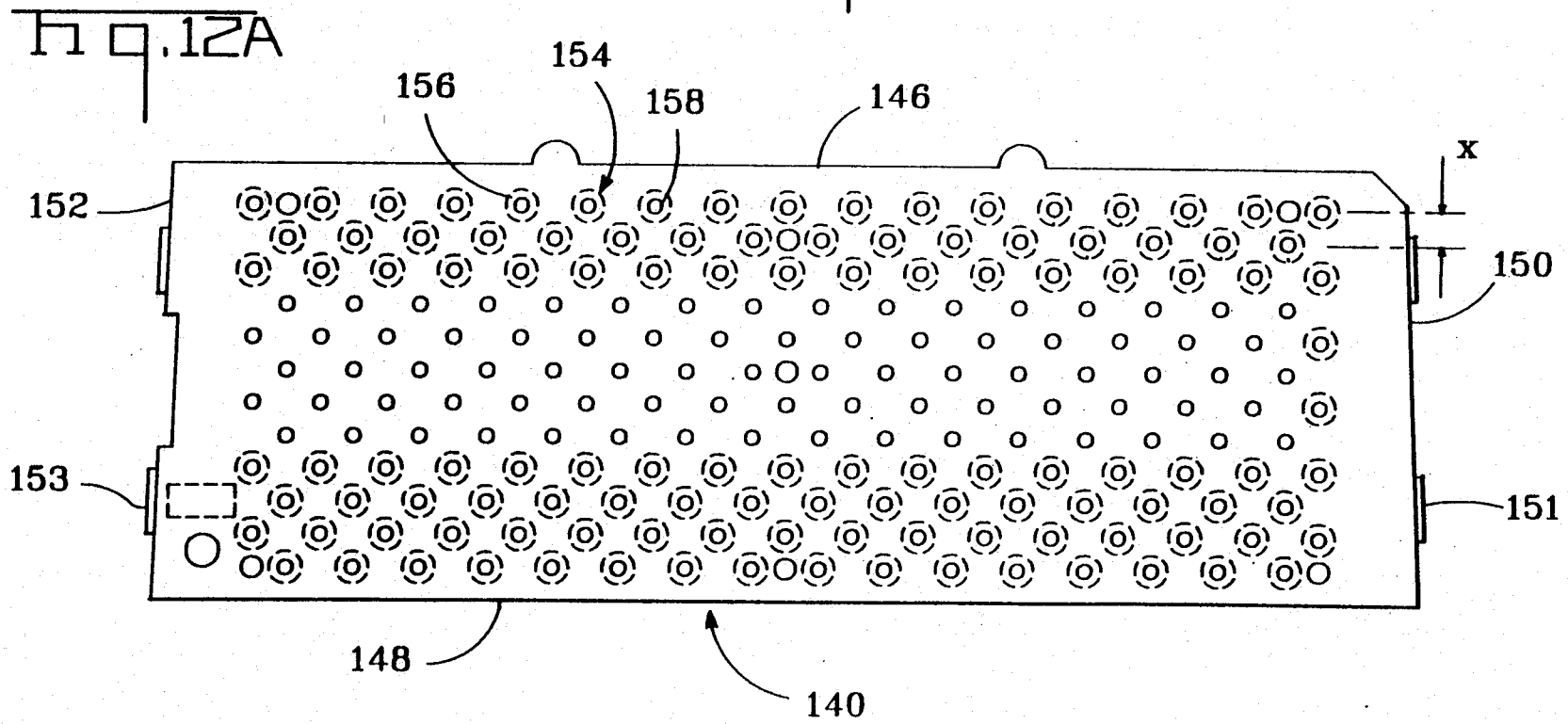
FIG. 12A is a top plan view of the tine plate of the subject invention.

With reference now to FIGS. 12a and 12b, a tine plate 140 is shown as including an upper surface 142 and a lower surface 144. The tine plate 140 also includes a forward edge 146, a rear edge 148, and side edges 150 and 152. It should also be noted that the tine plate includes twelve rows of apertures, such as 154, where each of the apertures includes a conical lead in section 156 and a narrowed aperture 158. The adjacent rows of apertures 154 have centerline spacings, such as "x" shown in FIG. 12, equal to the spacing between the alternate printed circuit board tab portions 101j and 101k, as described with respect to FIG. 7. It should also be understood that the distance between consecutive tab sections in adjacent terminals is also equal to x, for example, the distance between 101j and 102k; and 102j and 103k.

With reference now to FIG. 13, the terminals 101–106 are shown inserted within the respective terminal receiving passageways, the terminals being inserted such that the lower surfaces, such as 101h and 102h (FIG. 7), are in an abutting manner with respective surfaces, such as 38c and 38d (FIG. 6). As shown in FIG. 6, the terminals are positioned within the terminal receiving passageways, such that the front shoulder, such as 101g, is slid into the respective slot 40, to a position where the shoulder 101g abuts the forward surface 40b. It should be noted that the shoulders, such as 40b and 42b, are axially staggered which, as shown in FIG. 13, axially staggers the contact surfaces, such as 101f and 102f. It should be understood that when the terminal lead frame 100 is inserted from the rear side of the connector housing 4, one of the printed circuit board tine sections, such as 101j or 101k, is selected, depending on the lateral position of the lead frame to stagger the printed circuit board tine sections into the configuration of the tine plate 140 as shown in FIG. 12A. It should also be understood that for each lead frame the same printed circuit board tine is selected, while the other tine is stamped free of the terminal, for example, as shown in FIG. 13. With the terminals 101 through 106 inserted within their respective terminal receiving passageways, the tine plate 140 can be aligned with the individual tines and then moved upwardly to a position where the latches 151 and 153 snap in place within the slots 78 and 80 (FIG. 5), thereby maintaining the individual tines in their requisite array.

The drain wires 130 can now be inserted within their corresponding grooves 60 and 62 such that the hook sections 134 are positioned within the slots, such as 60c and 62c, and the side sections 133 are positioned within the grooves 60b and 60c, and the frontal portion 132 resides within the front groove sections 60a and 62a. The indentations 60d and 62d assist in retaining the drain wire portion 132 within the respective groove sections. The shield 120 can now be inserted over the housing such that the drawn shroud section 124 is placed over the shroud portion 118 of the housing 4 and the plate section 122 abuts the forward surface 12 (FIG. 2) of the housing 4, and consequently traps the drain wire in place. The tabs 128 and 129 can then be bent about the central wall section 10 to reside in the respective recesses 90 and 92 thereby retaining the shield member 120 to the housing member 4, and ensuring that the shield 120 and drain wires 130 are commoned together.

Figure 17:
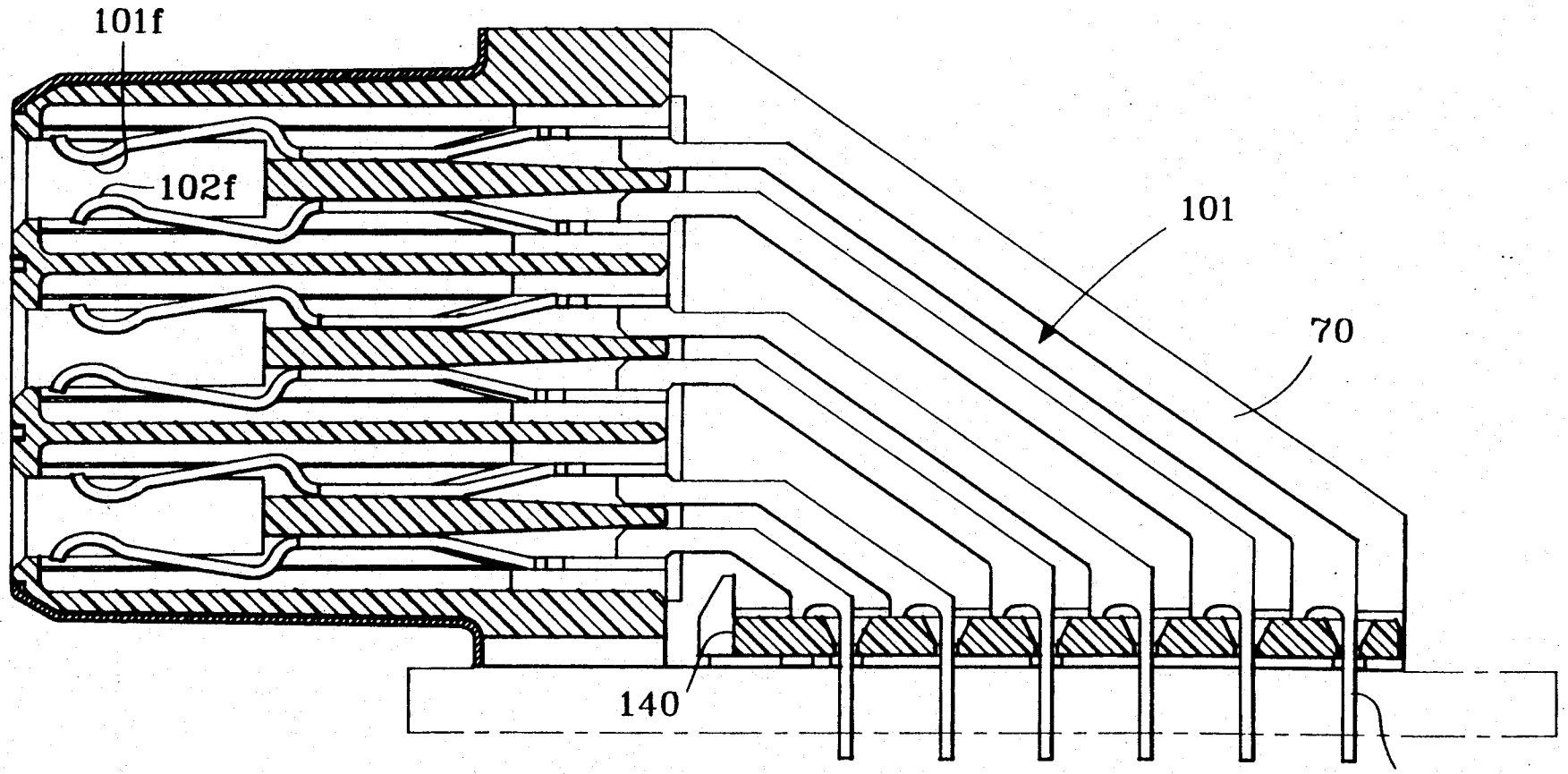
FIG. 17 is a cross-sectional view through lines 17—17 of FIG. 15.
Figure 14:
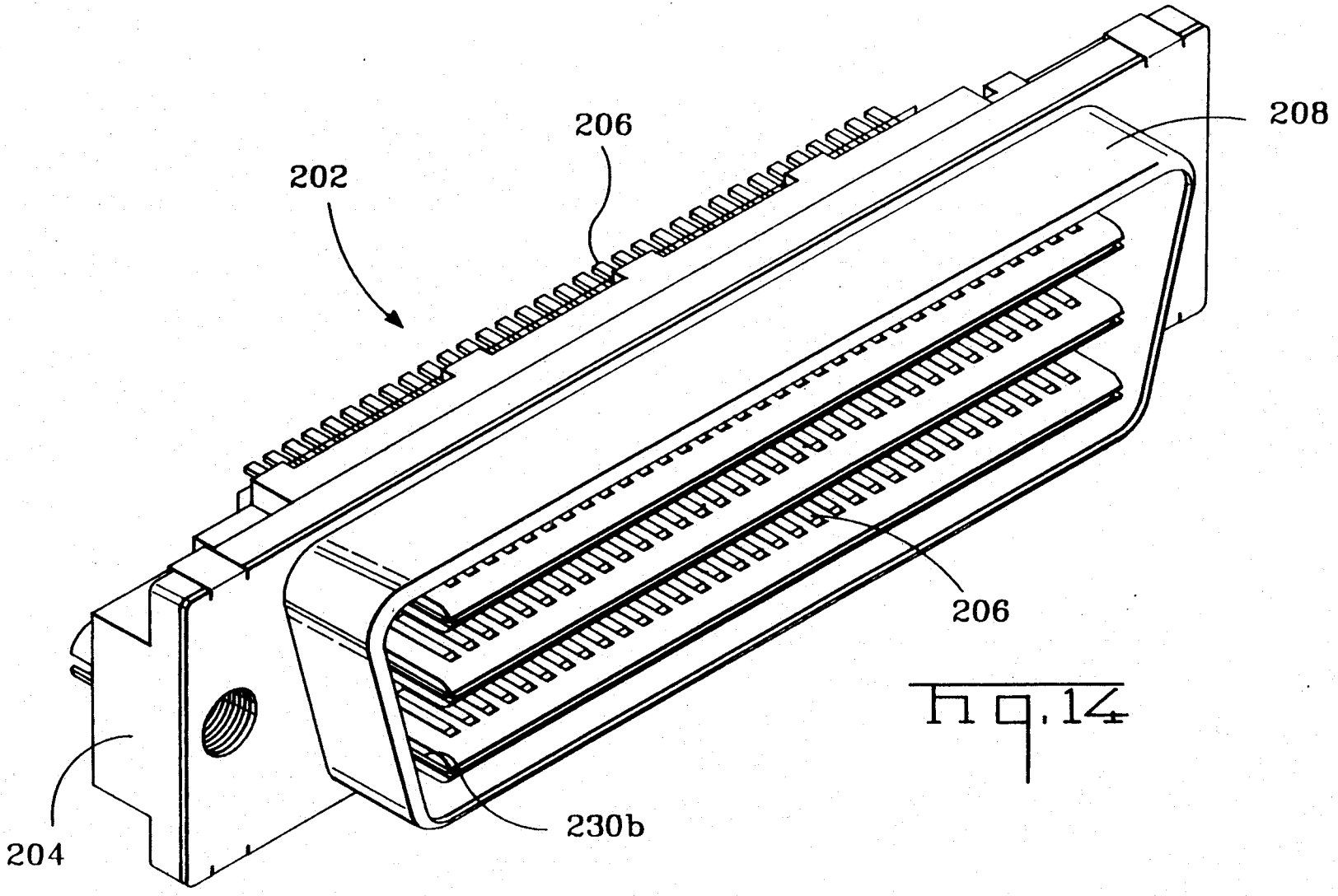
FIG. 14 is a front isometric view of a vertical plug connector of the subject invention.
Figures 16A, 17, 18:
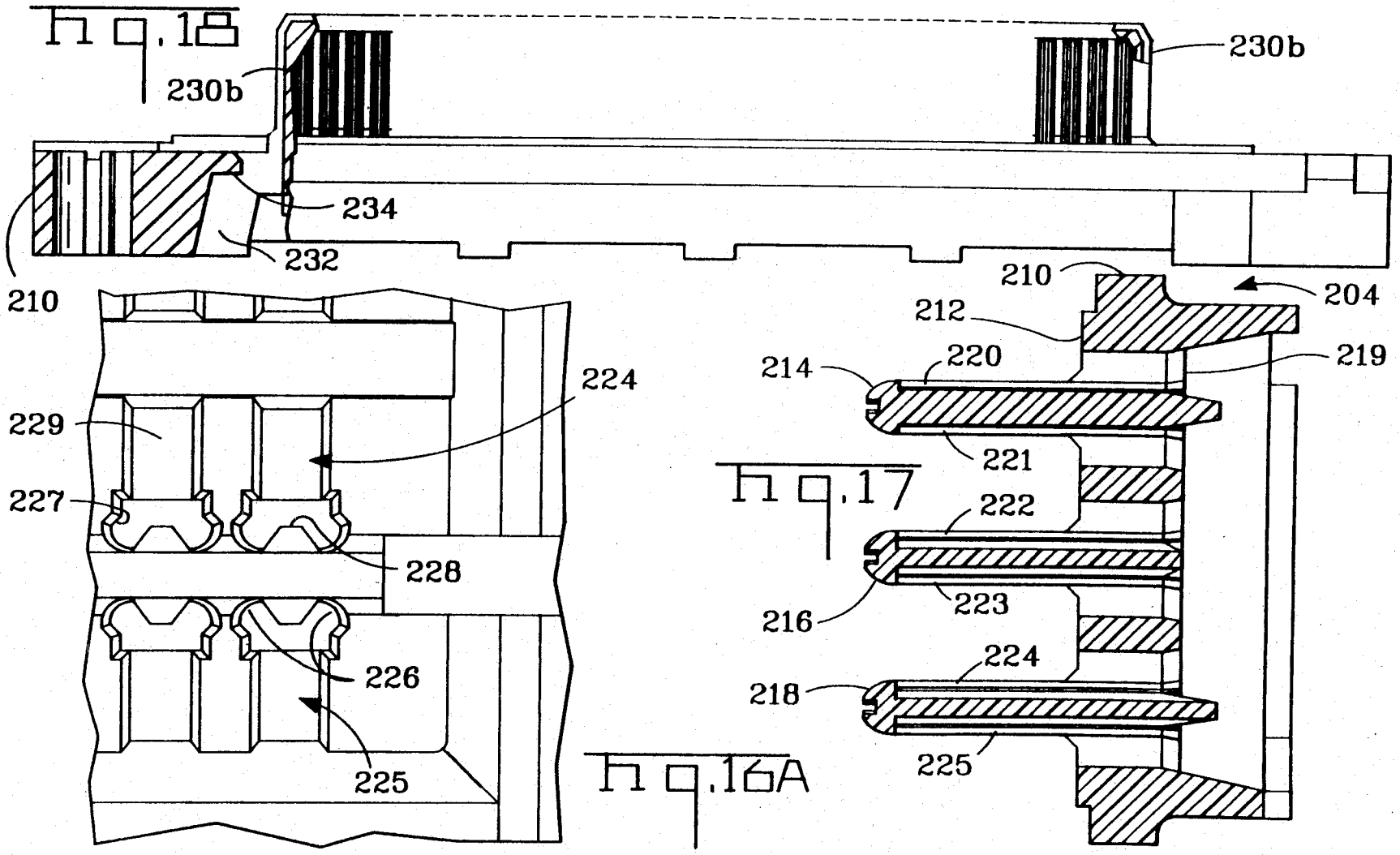
FIG. 16A is an enlarged view of the terminal passageways viewed in FIG. 16.
FIG. 18 is a top plan view of the housing of FIG. 16.
Figure 21:
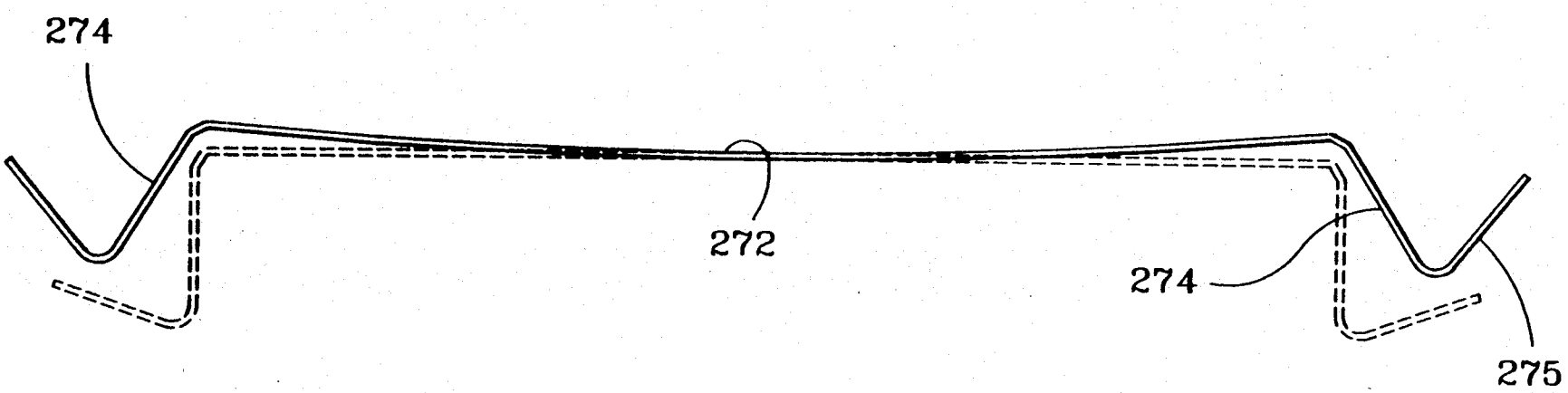
FIG. 21 is a drain wire used with the vertical plug connector of FIG. 14.

With reference now to FIG. 14, a mating plug connector 202 is shown generally comprising a housing 204 having a plurality of electrical terminals 206, and comprising an outer shielding shell 208. As shown in FIG. 18, the housing 204 comprises a central wall section 210, shaped with an interior as shown at 232 and 234, having a front mating face 212 thereof, with terminal receiving platforms 214, 216, and 218 extending forwardly and integrally from the front face 212 of the central wall portion 210. The housing 204 further comprises a rear wall portion 219 having terminal receiving passageways 220 to 225 extending forwardly therefrom. As shown in FIG. 16a, the terminal receiving passageways 220 through 225 are generally shaped as keyhole slots having flared channels shown generally at 226, (thereby forming shoulders 227, and platform 228), and a rectangular slot portion shown generally as 229. As shown in FIG. 17, the slots 220–225 do not extend through the front of the platforms 214–218, but rather end proximate to the forward end of each of the platforms.

Figure 15:
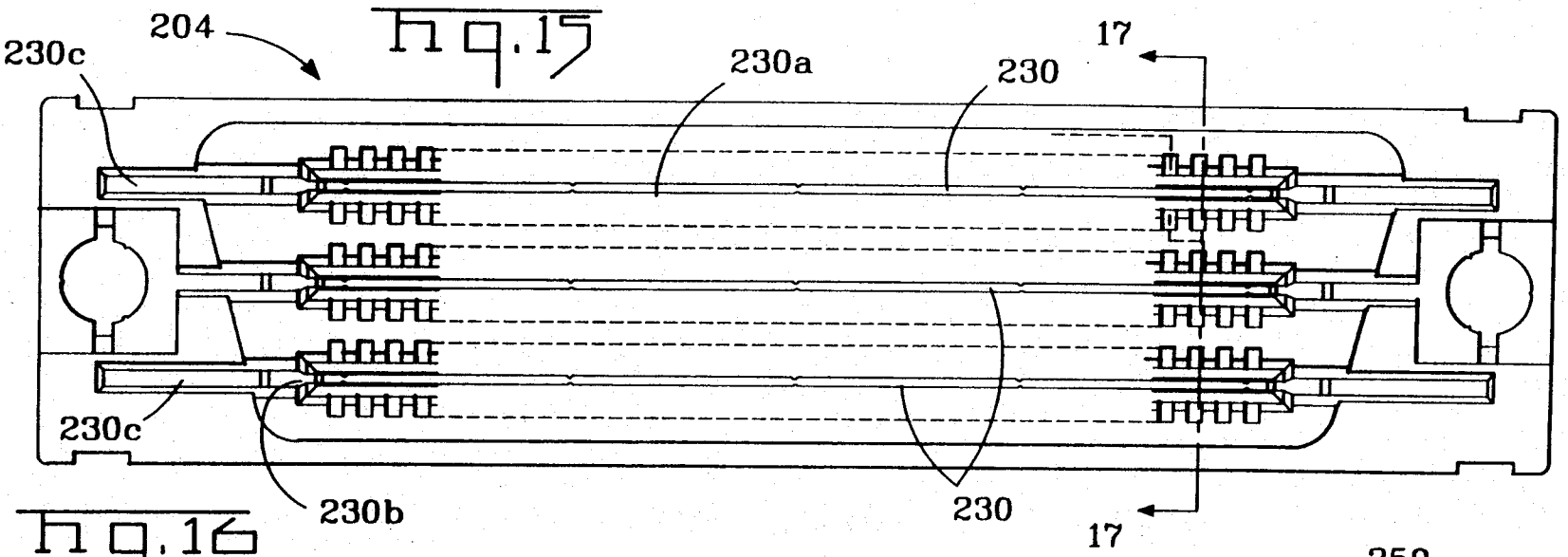
FIG. 15 is a front plan view of the housing of the plug connector shown in FIG. 14.

With reference now to FIG. 15, each of the platforms 214–218 includes a groove 230 therein including a front portion 230a and side portions 230b, as shown in FIGS. 14 and 18. The side groove 230b extends rearwardly along the platforms 218, 216, 214, and then extends outwardly along the face, as at 230c.

With reference now to FIGS. 19A through 19C, the connector comprises a plurality of terminals 250, 252, and 254. As shown in FIG. 19A, the terminal 250 comprises a forward contact section 250a and a rearward printed circuit board contact portion 250b. The terminal 250 further includes locking barbs 250c, and retention arms or wings 250d extending from each side of the contact portion and extending downwardly, and profiled for a receipt within the sections 226 (FIG. 16A). As shown in FIGS. 19B and 19C, the terminals 252, 254 comprise contact surfaces 252a, 254a, printed circuit board contacts 252b, 254b, barbs 252c, 254c and locking arms 252d, 254d.

Figure 16:
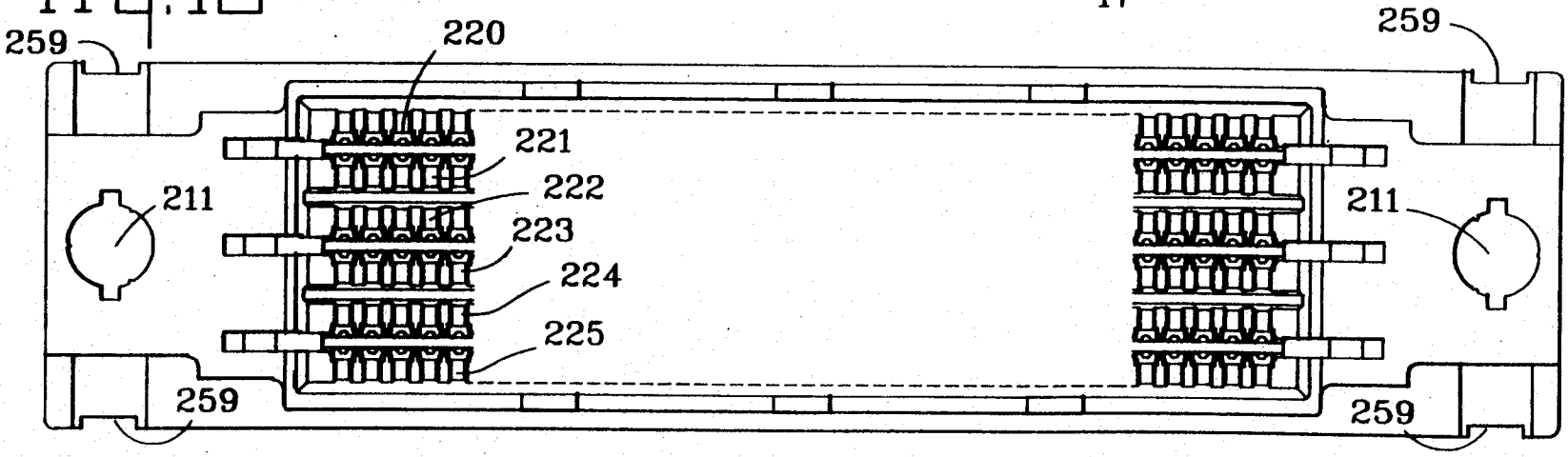
FIG. 16 is a rear plan view of the housing of FIGS. 14 and 15.

With reference now to FIG. 23, the terminal portions 254 are first inserted into the center terminal receiving passageways 222 and 223 (FIG. 16), with the locking arm portions 254 appropriately positioned in the sections 226 (FIG. 16) of the terminal passageways. As shown in FIGS. 16 and 17, the sections 226 extend the entire length of the passageways 220–225, thereby aligning and retaining the respective terminals within the respective passageways. The terminals, while cantilevered out on the respective platforms 214, 216, 218, are prevented from movement by way of the locking wings 250*d*, 252*d* and 254*d* against the shoulders 227 within the respective terminal receiving passageway. This positions the printed circuit board contact portions 254*b* extending beyond the rear face of the plug housing 204. The terminals 252 are next inserted in the passageways 221 and 224, once again with the locking arm sections 252*d* appropriately positioned in the sections 226 (FIG. 16) of the terminal passageways 221 and 224. This places the printed circuit board contact 252*b* in a staggered position towards the printed circuit board portions 254*b*, as shown in FIG. 23. The terminals 250 are then inserted in the rows of terminal passageways 220 and 225 with the retaining arms 250*d* in the respective sections 226, such that the printed circuit board contact portions 250*b* are staggered towards the printed circuit board contact portions 252*b*, as shown in FIG. 23.

Figure 26:
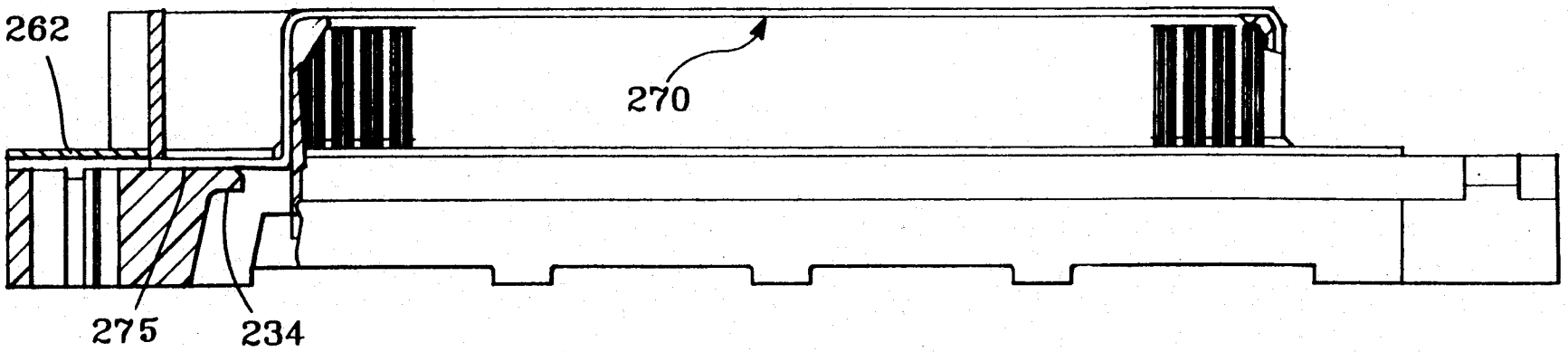
FIG. 26 is a top plan view of an insulating housing for use with the vertical receptacle assembly of FIG. 25.
Figure 25:
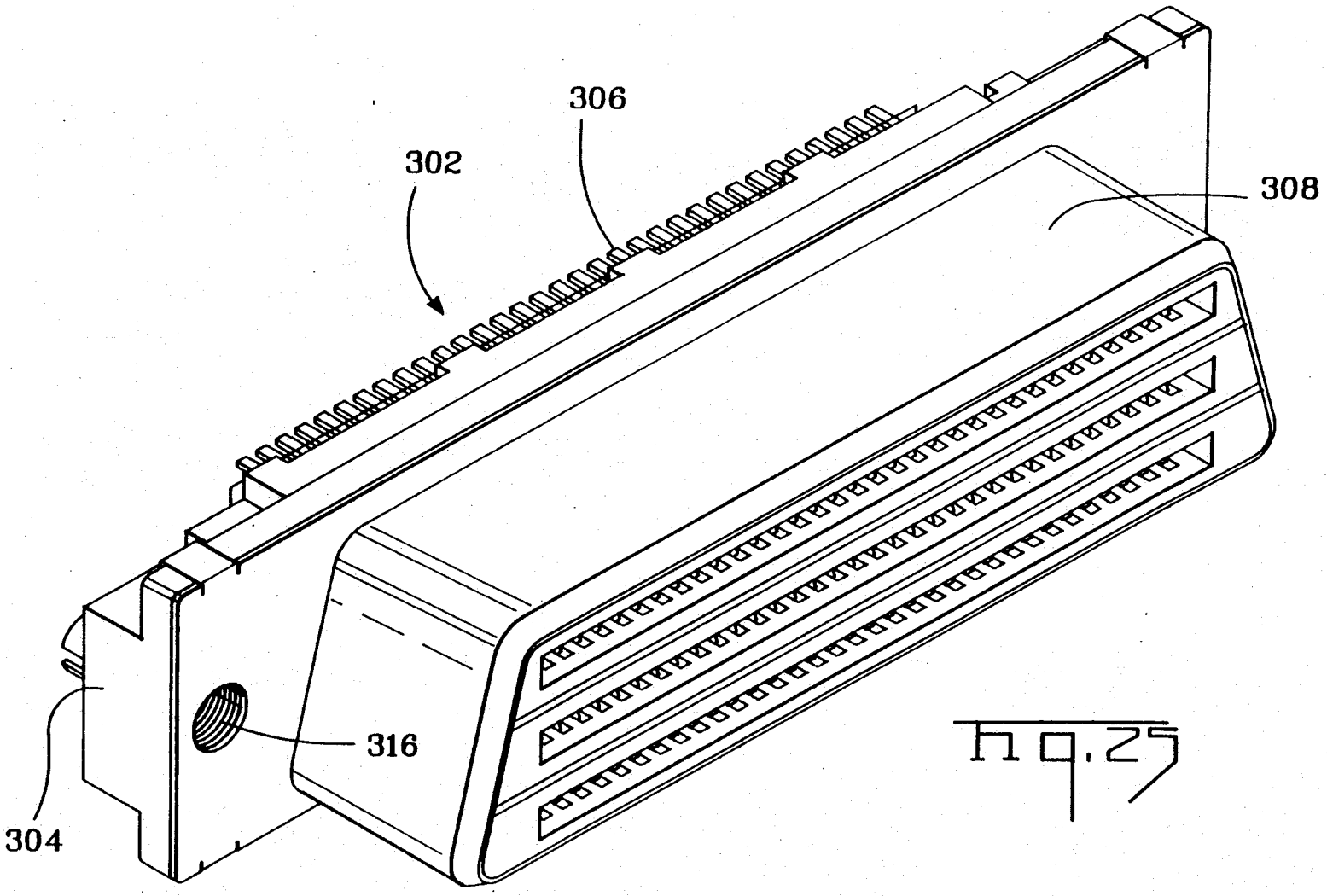
FIG. 25 is an isometric view of an alternate embodiment vertical receptacle.
Figure 27:
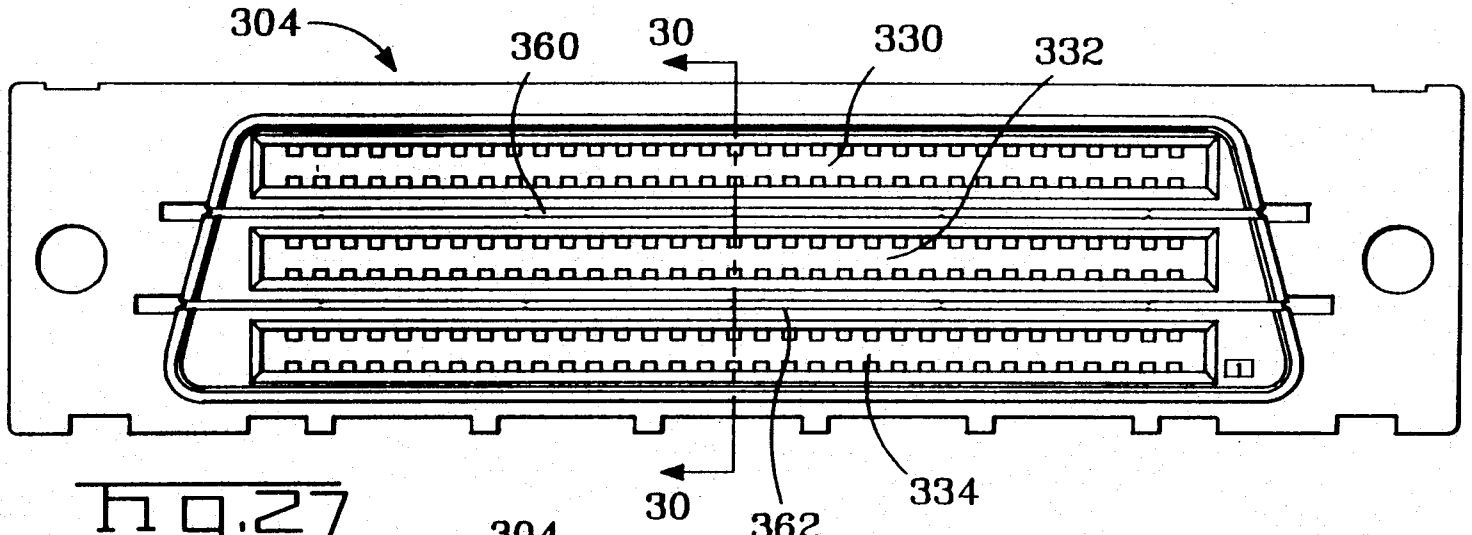

With reference now to FIG. 26, the drain wires 270 are inserted into their respective grooves 230 with the drain wire portions 272 positioned along the groove sections 230*a* and the drain wire side portions 274 positioned along the groove portions 230*b* (FIG. 14). Continued insertion of the drain wire positions the wire portions 275 within the respective grooves 230*c*. The shield member 208 is now insertable over the housing 204 with the tabs 266 folded over in locking engagement with the recesses 259 (FIG. 16). As assembled, the portions 275 of the drain wire are in spring-loaded engagement against the backside of the plate portion 262 of the shield member 260 as shown in FIGS. 24 and 26, assuring an adequate grounding between the drain wire and the shield member 260.

Figure 22:
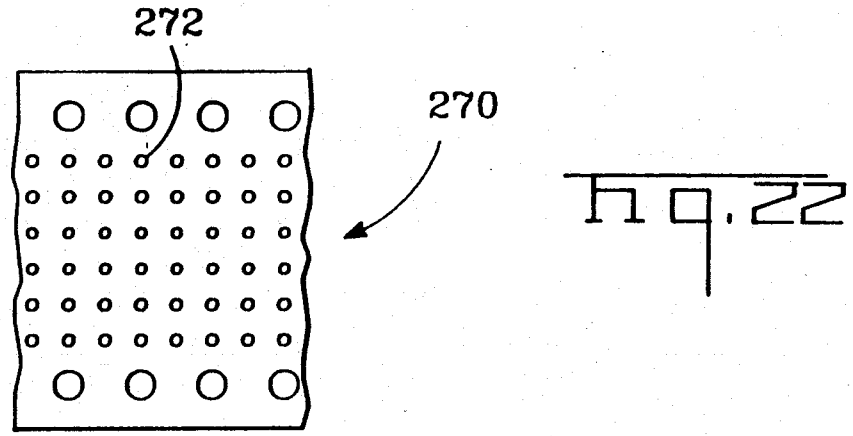
FIG. 22 is a tine plate used with the vertical plug connector of FIG. 14.

To maintain the printed circuit board terminal portions 250*b*, 252*b*, and 254*b*, in the predetermined array as shown in FIG. 22, a mylar sheet, such as 270, as shown in FIG. 22, is positioned over the backside of the housing member 204 and has a plurality of apertures, such as 272, positioned over the printed circuit board portions 250*b*, 252*b*, and 254*b*.

Figure 24:
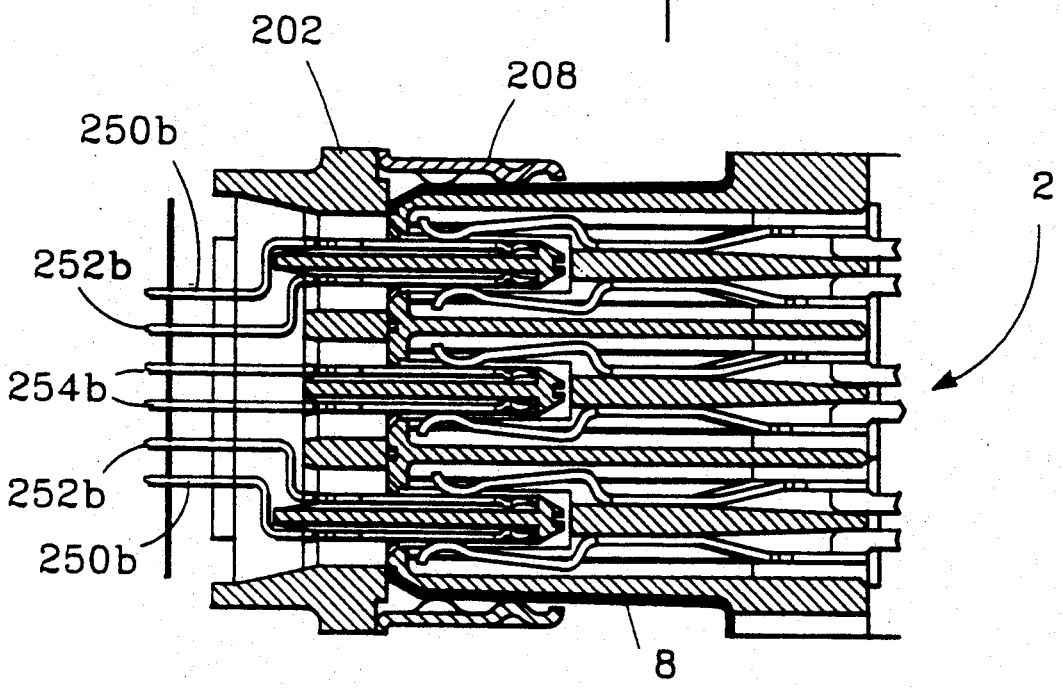
FIG. 24 shows a cross-sectional view of the mated receptacle and plug member.

As shown now in FIG. 24, the terminal receiving platforms 214, 216, and 218 are receivable in the slots 30, 32, and 34 of the receptacle housing in order to position the receptacle contacts 101–106 in mating engagement with the plug contacts 250, 252, and 254. As also shown in FIG. 24, as mated, the shield 208 of the plug member is in mating engagement with the outer shield 8 of the receptacle member 2.

With reference now to FIGS. 25 through 33, an alternate embodiment of the receptacle connector is shown generally at 302 comprising an insulative housing 304 carrying a plurality of contacts 306 and having threaded mounting holes 316 and an external shield, such as 308.

Figure 27:
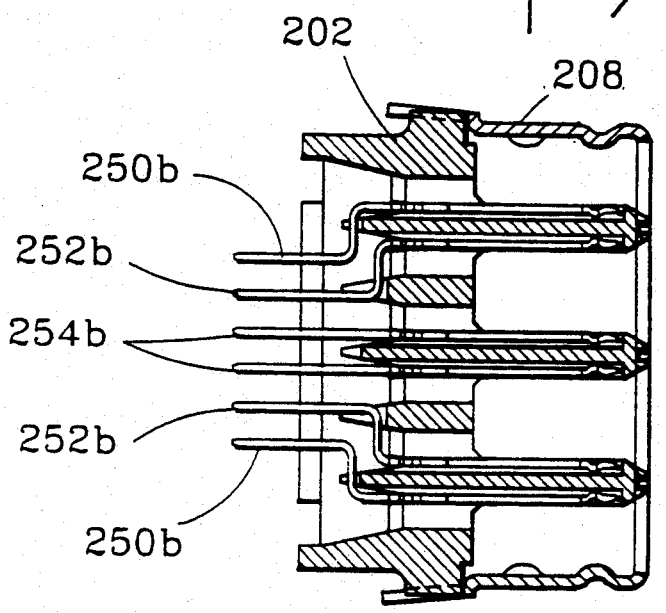
FIG. 27 is a front plan view of the assembled vertical receptacle.
Figure 28:
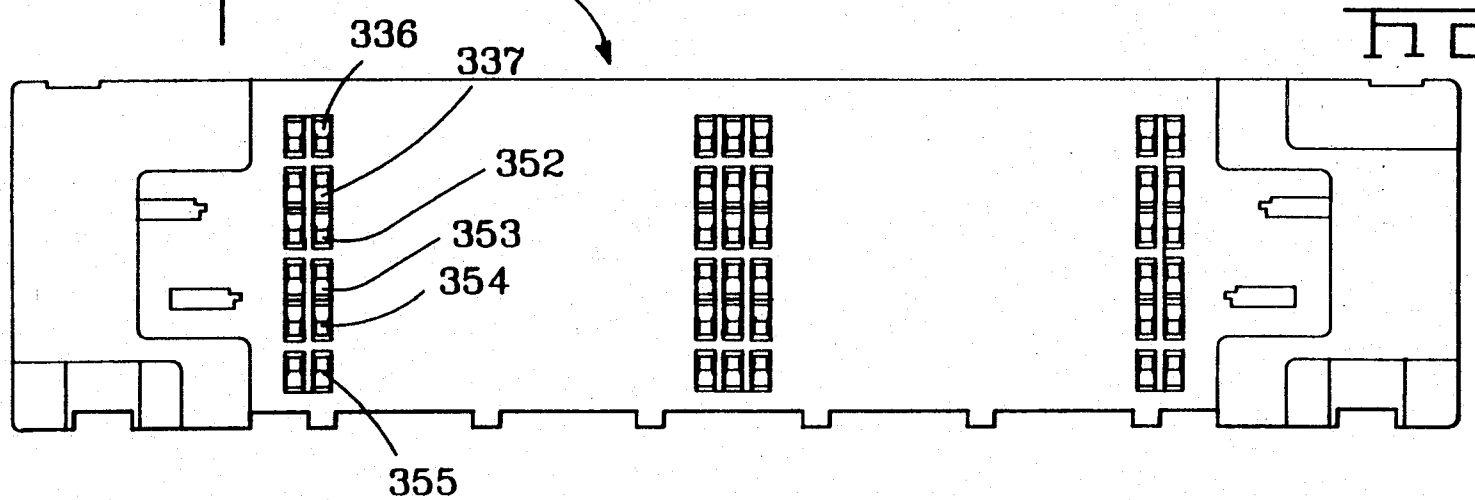
FIG. 28 is a rear plan view of the housing shown in FIGS. 23 and 24.

With reference first to FIG. 27, the housing 304 is similar in nature to the housing shown in FIG. 2, having elongate slots 330, 332, and 334 similarly profiled to receive the terminal support platforms 214, 216, 218 (FIG. 17) of the plug connector 204. Also similarly, as shown in FIG. 27, the vertical receptacle includes grooves 360 and 362 for the receipt of a drain wire which is identical to that shown in FIG. 11. Also similar in nature to the right-angled mount receptacle connector 2, as shown in FIG. 28, the receptacle connector 304 includes terminal receiving passageways 336, 337, 352, 353, 354, and 355, each of which is profiled as shown in FIG. 30.

As shown in FIG. 31, a terminal for use with the vertical receptacle member is shown generally at 400 and comprises a forward contact section 400*a* and a printed circuit board mount portion 400*b*. A forward positioning shoulder 400*c* abuts the shoulder in the terminal receiving passageways in a similar nature as that shown in FIG. 13 above. Also similar to that shown above, the receptacle housing 304 can receive the drain wire shown in FIG. 11 in the slots 360 and 362 (FIG. 27) and are spring-loaded in place when the shield is positioned against the housing as shown in FIG. 26.

As designed above, the preferred embodiment of the invention includes a receptacle and plug connector where each connector has six rows of electrical terminals. By including plural rows of terminals, a preferred embodiment connector can accommodate up to 198 contacts in each electrical connector, with the contacts being positioned on 0.050 inch centerlines. Also in the preferred embodiment of the invention, twelve rows of through holes 154 are provided, where each row is spaced apart a distance x, equal to 0.050 inches.

While the form of apparatus herein described constitutes a preferred embodiment of this invention, it is to be understood that the invention is not limited to this precise form of apparatus, and that changes may be made therein without departing from the scope of the invention which is defined in the appended claims.

We claim:

1. An electrical receptacle connector, comprising:

an insulating housing having a front mating face and a conductor connecting face, at least two elongate slotted openings extending through said front mating face and terminating at a rear wall, shielding means surrounding said slotted openings, and rear wall having two rows of passageways extending therethrough communicating with each said slot, one said row being adjacent to an upper surface in each said slotted opening, and one said row being adjacent to a lower surface in each said slotted opening; and a plurality of electrical terminals positioned in said housing, said terminals comprising, contact portions and a discrete lead section extending from each said contact portion rearwardly of said front mating face, thereby defining printed circuit board contacts, said terminals positioned in said passageways with contact portions positioned adjacent to said upper surface in each said slotted opening, and a contact portion positioned adjacent to said lower surface in each said slotted opening, with contact surfaces facing opposite contact surfaces in the same slotted opening.

2. The electrical connector of claim 1, wherein said shielding means comprises an outer shielding shell surrounding said slotted openings.

3. An electrical receptacle connector, comprising:

an insulating housing having a front mating face and a conductor connecting face, at least two elongate slotted openings extending through said front mating face and terminating at a rear wall, said rear wall having two rows of passageways extending therethrough communicating with each said slotted opening, said rows of passageways are laterally aligned to form a column of at least four passageways, one said row being adjacent to an upper surface in each said slotted opening, and one said row being adjacent to a lower surface in each said slotted opening; and a plurality of electrical terminals positioned in said housing, said terminals comprising, contact portions and a discrete lead section extending from each said contact portion rearwardly of said front mating face, thereby defining printed circuit board contacts, said terminals positioned in said passageways with contact portions positioned adjacent to said upper surface in each said slotted opening, and a contact portion positioned adjacent to said lower surface in each said slotted opening, with contact surfaces facing opposite contact surfaces in the same slotted opening.

4. The electrical connector of claim 3, wherein said terminals are edge stamped from a sheet of metal, to form the printed circuit portions extending substantially in a plane parallel to said columns.

5. The electrical connector of claim 4, wherein terminals are positioned in pairs, with each said pair occupying one said slot, defining an upper and lower terminal in each said slot, where each said terminal includes a cantilevered contact arm.

6. The electrical connector of claim 5, wherein said upper cantilevered contact arm extends integrally from an upper edge of said edge stamped terminal, and said lower cantilevered contact arm extends integrally from a lower edge of said edge stamped terminal, where said upper and lower cantilevered contact arms are bent to form two opposed contact arms.

7. A right-angled receptacle connector, comprising:

an insulating housing having a front mating face and a rear terminal receiving face, said front face including three parallel elongate slots extending across said front mating face, each said slot being defined by upper and lower surfaces, end surfaces and a rear surface, said upper and lower surfaces each having laterally spaced channels formed therein, where each said channel is in alignment with a terminal receiving passageway extending between said rear surface and terminal receiving surface, said terminal receiving passageways forming six parallel rows through said rear terminal receiving face, said rows thereby defining a plurality of columns of six passageways, and two mounting feet extending from said rear face and flanking said terminal receiving passageways, said mounting feet being adapted to position said front face in a plane perpendicular to a printed circuit upon mounting said housing to the printed circuit board;

a plurality of electrical terminals positioned in said housing, each said terminal comprising a contact portion, a cantilevered portion, an intermediate portion and a printed circuit board tine, said cantilevered portions being positioned in said respective channels with said contact portion adjacent to said front mating face, said intermediate portions lying in a plane parallel to said columns and extending rearwardly of said terminal receiving face and intermediate said mounting feet, said printed circuit board tines extending below and perpendicular to said mounting edges, and a tine plate having a plurality of apertures extending therethrough for receipt of said printed circuit board tines therethrough, said tine plate being snap latched between said mounting feet.

8. The receptacle of claim 7 wherein said can portions are formed in a plane parallel to said slots while said intermediate portions are formed in a plane parallel to said columns.

9. The receptacle of claim 8 wherein said cantilevered portions adjacent to said upper surface in each said slot are integral with a front upper edge of said intermediate portion, and said cantilevered portions adjacent to said lower surfaces in each said slot are integral with a front lower edge of said intermediate portion.

10. The receptacle of claim 9 wherein said cantilevered portions and intermediate portions are at right angles to each other and integrally interconnected along a common fold line.

11. An electrical plug connector, comprising:

an insulating housing having a front mating face, a rear conductor connecting face, and an intermediate wall between said front mating face and said rear conductor connecting face, said housing comprising at least two elongate terminal support platforms extending outwardly from said intermediate wall, where each said platform includes terminal receiving channels formed integrally therein, along a length of said platforms, and on both upper and lower faces thereof; and a plurality of electrical terminals, each comprising a front mating contact portion disposed in said terminal receiving channels, and conductor connecting portions positioned adjacent to said conductor connecting face.

12. The electrical plug connector of claim 11, wherein said housing has three terminal support platforms and six rows of terminals positioned therein.

13. An electrical connector assembly, comprising:

a receptacle connector comprising an insulating housing having a front mating face and a conductor connecting face, said housing comprising at least two elongate slots extending inwardly from said front mating face to a rear wall of said housing, thereby defining an end face to said slot, wherein each said slot has an upper and lower row of discrete terminal passageways through said rear wall communicating between said slots and said conductor connecting face, said receptacle connector further comprising a plurality of electrical terminals positioned in said housing with said terminals being positioned in said terminal passageways forming two opposed rows of discrete resilient receptacle contacts in each said slot, said terminals further comprising conductor connecting portions extending from said rear wall adjacent to s id conductor connecting face; and a plug connector comprising an insulating housing comprising a rear wall portion having a plurality of terminal support platforms extending forwardly therefrom, said platforms being in like number as said open slots of said receptacle connector, said plug rear wall portion having terminal passageways therethrough, above and below said platforms and in communication with channels disposed in upper and lower surfaces of said platforms, said plug connector further comprising a plurality of electrical terminals having contact sections positioned in said channels and conductor connecting sections adjacent to said conductor connecting face, thereby defining rows of contacts disposed above and below said terminal support platforms, said plug connector being adapted for mateable engagement with said receptacle connector with each said platform being insertable in a respective slot in said receptacle housing intermediate said opposed contact rows in the same said slot, causing interconnection between said receptacle contact portions and said plug contact portions, thereby forming a plurality of rows of discrete electrical connections.

14. A plug type electrical connector comprising:

a block of insulative material, said block of insulative material including a widened base section and a narrower section integrally formed with and extending from said widened base section, said narrower section of said block of insulative material having a top side, a bottom side and a leading edge;

at least one electrical contact mounted to each of said top and bottom sides of said narrower section of said block of insulative material; and a conductive outer shell attached to said widened base section of said block of insulative material, said conductive outer shell at least partially surrounding said narrower section of said block of insulative material.

15. A plug type multiple contact electrical connector comprising:

a body portion formed from an insulative material, said body portion having a base and at least one outwardly projecting blade member extending from said base and terminating in a leading edge;

a plurality of electrical contacts mounted to each of said at least one projecting blade members; and an outer housing formed form an electrically conductive material and attached to said insulative body portion, said conductive outer housing at least partially surrounding said at least one projecting blade member.

16. A plug type electrical connector as set forth in claim 15, wherein each of said electrical contacts further comprises an electrical contact for providing a first electrical connection and a pin connector for providing a second electrical connection.

17. A plug type electrical connector as set forth in claim 16, wherein said at least one projecting blade member further comprises first, second and third projecting blades.

18. A plug type electrical connector as set forth in claim 17, wherein said projecting blades further include top and bottom sides and wherein electrical contacts are mounted on both said top and bottom sides of each of said projecting blades.

19. A plug type electrical connector as set forth in claim 18, wherein said top and bottom sides of each of said projecting blades are slotted and wherein said electrical contacts are insertably mounted in said slots.

* * * * *